United States Patent [19]

Kunz et al.

[11] 4,136,862

[45] Jan. 30, 1979

[54] PAPER ORIENTATION FOR DUPLEXING AND COLLATING

[75] Inventors: Barton H. Kunz, Longmont; Myron F. Shlatz, Boulder; Lowell M. Simson, Louisville, all of Colo.

[73] Assignee: International Business Machines Corporation, Armonk, N.Y.

[21] Appl. No.: 787,140

[22] Filed: Apr. 13, 1977

[51] Int. Cl.[2] ..... B65H 29/00

[52] U.S. Cl. ..... 271/186; 271/DIG. 9; 271/225

[58] Field of Search ..... 271/DIG. 9, 65, 186, 271/187, 225, 235

[56] References Cited

U.S. PATENT DOCUMENTS

| | | | |
|---|---|---|---|
| 4,019,435 | 4/1977 | Davis | 271/186 X |
| 4,036,488 | 7/1977 | Allen | 271/186 |

*Primary Examiner*—Richard A. Schacher
*Attorney, Agent, or Firm*—Charles E. Rohrer

[57] ABSTRACT

Method and apparatus for automatically producing a duplexed copy in a document copier machine wherein the leading edge of the rectangular copy sheet is maintained during both passes through the machine and wherein both simplexed and duplexed copies may be collated. This method and apparatus is especially useful when the leading edge is the narrow dimension of the rectangular copy paper.

6 Claims, 5 Drawing Figures

FIG. 4
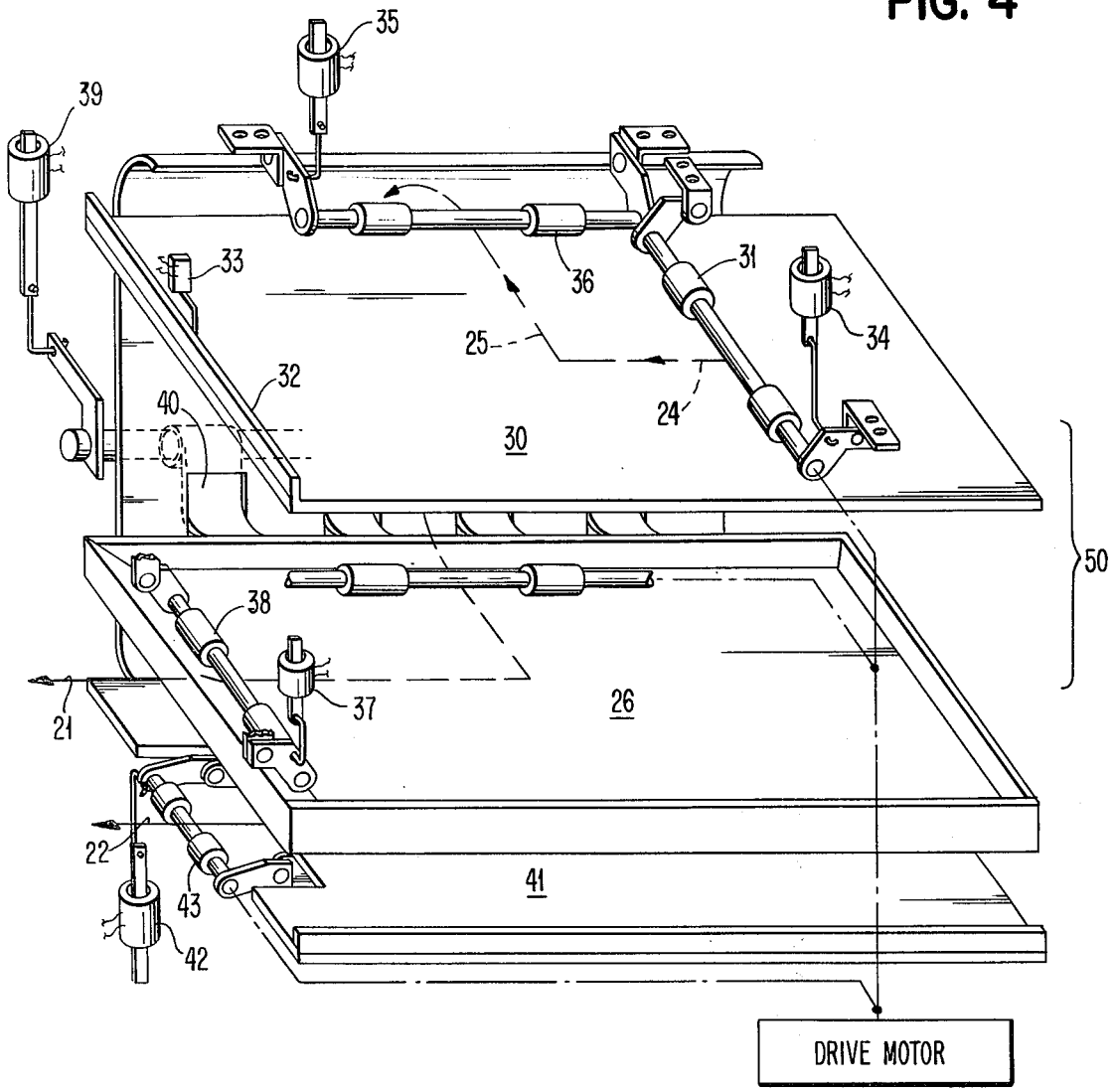
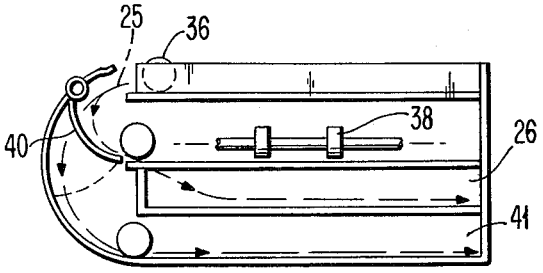
FIG. 4A

PAPER ORIENTATION FOR DUPLEXING AND COLLATING

This invention relates to document copier machines and more particularly to methods and apparatus for automatic duplexing and collating.

BACKGROUND OF THE INVENTION

In document copiers a duplexing operation refers to the provision of copies which carry document images on both sides of the copy sheet and collating refers to automatically organizing multiple sets of multi-page document copies in correct order. Several patents have issued which relate to apparatus for automatically performing the duplexing function, for example, U.S. Pat. Nos. 3,645,615; 3,851,872; 3,856,295; 3,615,129; and 3,917,256. All of these patents relate to an automatic duplexing operation, perhaps in conjunction with collating as well, when processing paper in the wide direction, e.g., the 11-inch direction for 8½ × 11-inch paper. These patents relate to the electrophotographic copier machine of the transfer type in which an image is typically produced on a rotating drum, the image is developed, the developed image is transferred to a sheet of copy paper and finally the image is fused to the copy paper. It is evident in this process that the leading edge of the copy paper must be mated to the leading edge of the image in order that the image may be transferred to the copy paper. Since all of the above-referenced prior art utilizes the wide side of the copy paper as the leading edge, if one wishes to copy on the reverse side of the copy paper, all of this prior art shows mechanisms to turn the paper over and utilize the opposite wide edge (e.g., 11-inch edge) as the leading edge on the second pass. In that manner, the top of a copy sheet containing printed word line matter is maintained on both sides of the copy sheet, assuming that the printed word lines read downwardly with the narrow dimension of the paper at the top.

Perhaps the major reason for the adoption of the wide side of the copy paper as the leading edge in automatic duplexing operations is that it is relatively simple to perform the necessary paper orientation in that system to maintain the top on both sides. Where the wide edge leads, as the copy paper leaves the fuser it is simply turned under (or over) the fuser, which turns the paper over and sends it back toward the drum; typically, the paper continues to move past the drum (under or over the drum), whereupon the paper is simply stopped and reversed toward the drum for copying on the second side. This paper reversal obviously causes the opposite edge to lead through the transfer station and therefore a correct duplexing operation is accomplished. However, when processing paper with the narrow edge leading, for example, the 8½-inch edge of an 8½ × 11-inch paper, the above duplexing scheme will not work since it results in the print on one side of the paper reading upside down to the print on the second side. For example, if the narrow leading edge is turned under the fuser, according to the above scheme, and returned past the drum, and if the top of the copied image is near the leading edge, and if now the opposite edge is made to lead into the drum, the top of the second side is printed oppositely to the bottom of the first side. It is, therefore, the primary object of this invention to provide a method and apparatus through which automatic duplexing may be accomplished together with a collating function for both simplexed and duplexed copies, where the leading edge of the copy paper is maintained during both passes through the copier. It is a further object of the invention to provide as simple a paper handling procedure and apparatus as possible.

SUMMARY OF THE INVENTION

Automatic duplexing of sheets fed through a document copier, wherein the simplexed sheet is received from a fuser, inverted while maintaining the leading edge, moved at 90° with a new leading edge and inverted, moved at 90° again so that the original leading edge resumes the lead, inverted and fed back for the secondary side copy. Upon receiving the duplexed sheet from the fuser, it is inverted and fed to the collator.

BRIEF DESCRIPTION OF THE DRAWINGS

The above-mentioned and other features and objects of this invention and the manner of attaining them will become more apparent and the invention itself will best be understood by reference to the following description of embodiments of the invention taken in conjunction with the accompanying drawings, the description of which follows.

FIGS. 4 and 4A show the apparatus of the instant invention.

DETAILED DESCRIPTION

Figure 1:
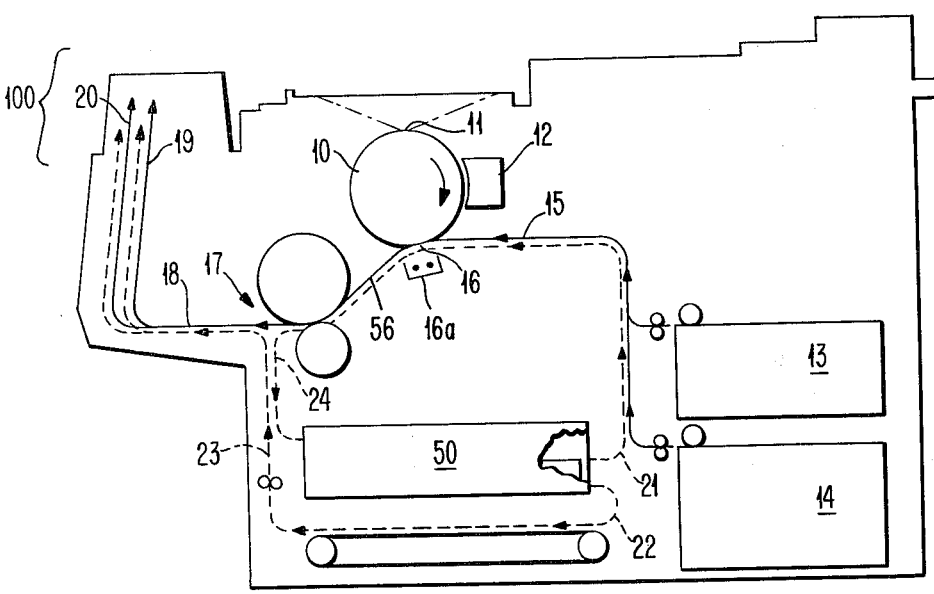
FIGS. 1 and 2 show paper paths of document copiers utilizing the instant invention.

FIG. 1 shows the paper path of a machine utilizing the apparatus of the instant invention to provide a simplexing/duplexing operation together with collate. In general, the simplex path is shown with a solid line while the duplex path is shown by a dashed line. In the machine a drum 10 is covered with a photosensitive material to receive an image of a document as shown at imaging station 11. As drum 10 rotates, the image is developed by developer 12 through the application of a powder which electrostatically adheres to the charged photosensitive surface. Copy paper is fed from either bin 13 or alternate paper bin 14 along the paper path 15 to a transfer station 16 at which the leading edge of the copy paper is mated to the leading edge of the image. Transfer of the image to the copy paper is accomplished under the influence of corona 16*a*. The copy paper is stripped from drum 10 by devices not shown and continues along paper path 56 through fusing rolls 17, where the developing powder is heated and fused to the copy paper. Thereafter, the copy paper may pass along paper path 18 into the first bin 19 of a collator 100. A second simplexed sheet operating in a collate mode would pass into the second bin 20 of the collator 100 and subsequent sheets would pass into subsequent bins. When the second sheet of the collated set was produced, that sheet would pass along the paper path into the collator bin 19 and be deposited directly behind sheet 1. The second copy of sheet 2 would pass into bin 20 and be deposited directly behind the first sheet. Similarly, subsequent copies of sheet 2 would pass into subsequent bins of the collator and be deposited directly behind the first sheet.

If it were desired to produce duplexed copies, i.e., side one on the first side and side 2 on the second side of a single sheet of paper, the paper path would be as follows. Copy paper from either bin 13 or 14 would pass along paper path 15, through transfer station 16, and fuser 17. Thereupon, instead of passing along paper path 18 a gate, not shown, would be activated to cause the paper to pass around a turnaround path 24 into the apparatus of this invention shown at 50. Herein the paper would be inverted but the leading edge of the document would be maintained so that when the paper passed out of apparatus 50 along paper path 21, it would enter into the paper path 15 and transfer station 16 with the leading edge maintained but the blank side up for contact with drum 10. The operation of apparatus 50 is fully explained below.

A collating problem now presents itself for the duplexed copy since if the paper continues through the fuser 17 and along paper path 18 into collator bin 19, the result would be that side 2 would be followed by side 1. When the next copy is made, it would come out side 4 followed by side 3 and thus the collating function would be destroyed by the duplexing function. In order to remedy this problem, the paper is not fed into the collator from the fuser but instead is once again fed around paper path 24 into the apparatus of this invention, where once again the paper is inverted and fed out along paper paths 22 and 23 to the collator bin. In that manner, side 1 followed by side 2 is stacked in bin 19 and it is followed by a sheet of paper containing side 3 followed by side 4. The operation of apparatus 50 is fully explained below.

Figure 2:
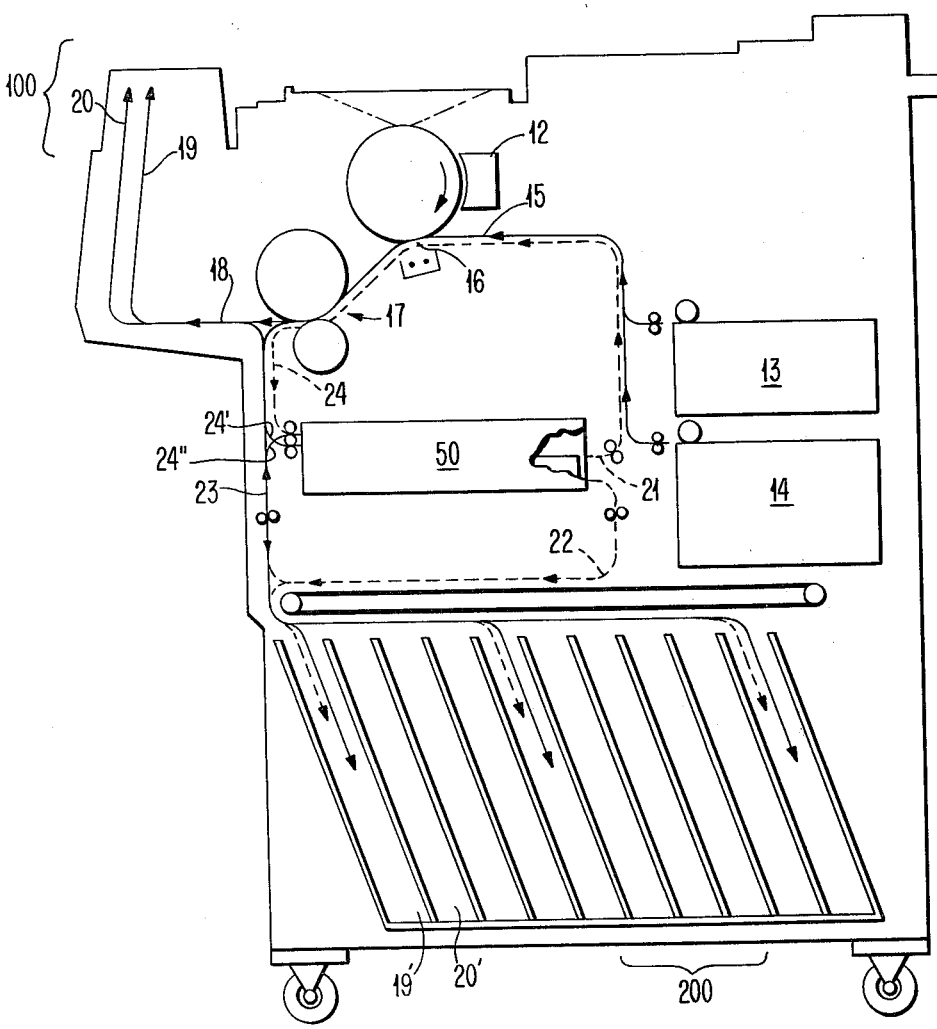
Figure 3:
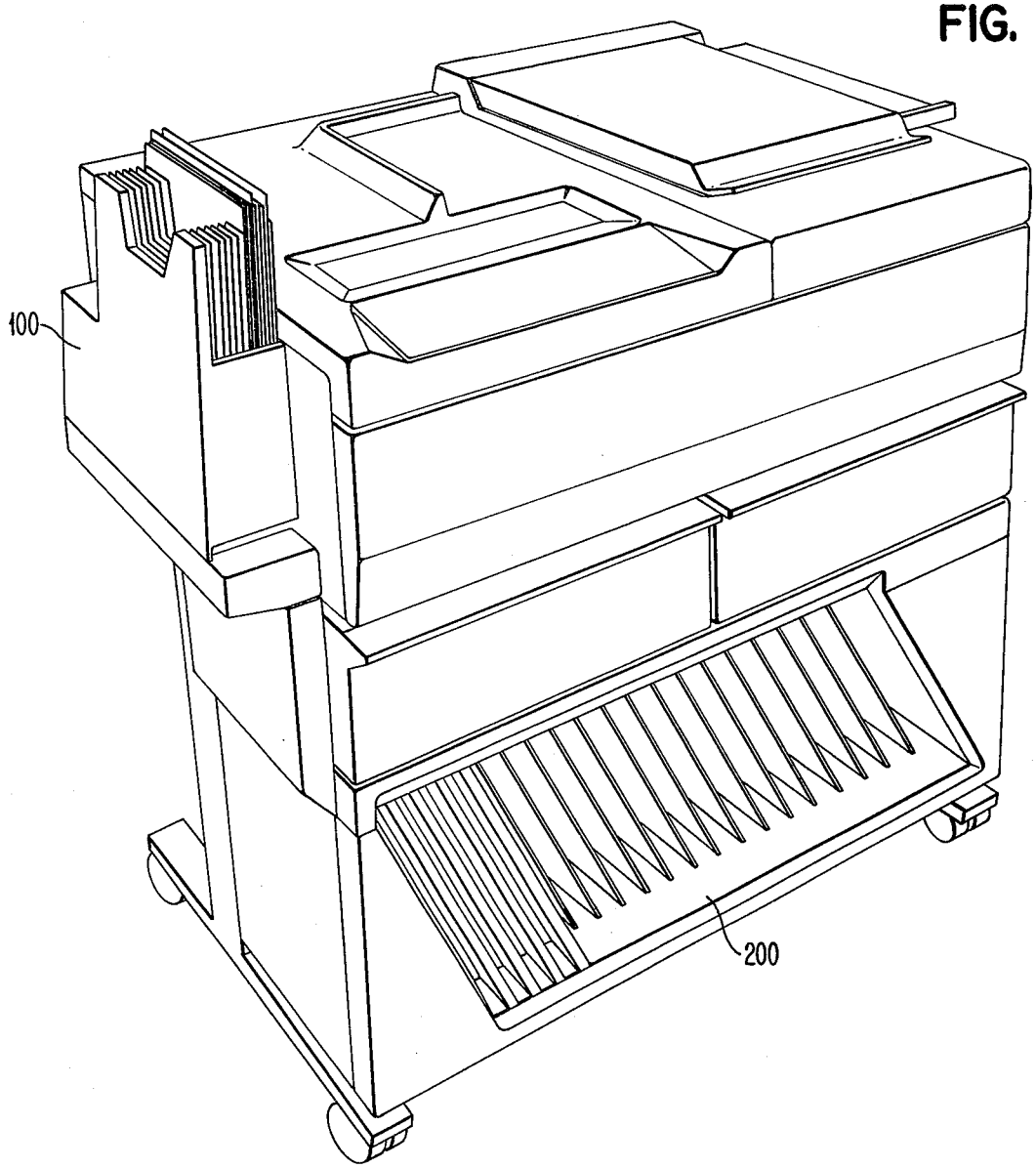
FIG. 3 shows the exterior of the machine of FIG. 2.

FIGS. 2 and 3 provide another arrangement of the paper path utilizing the apparatus of this invention. In this case the machine has two collators — a small collator 100 as before and a large collator 200 for large jobs. Referring to FIG. 2, the simplexed path is again shown with solid lines and is shown entering both the small collator at bins 19 and 20 via path 18 and the large collator at bins 19' and 20' via path 23. In this case, the duplexed copy is made the same as previously, however, when it is collated, it leaves the apparatus 50 along paper path 22 and is sent downwardly into bin 19'. While not shown, a gate could be provided so that the operator could select the small collator for duplexed copies if desired. The gate would send paper from path 22 to path 23 to collator 100. In any event, a paper path is shown by which either simplexed or duplexed copies can be collated in proper order in one of two collators by utilizing apparatus 50.

FIG. 4 is a perspective drawing showing apparatus 50. When it is desired to duplex, copy sheets enter top tray 30 along a path 24. The paper continues to move across tray 30 under the influence of rolls 31 until the leading edge of the paper strikes the reference edge 32 and the associated microswitch 33 which senses the presence of paper.

Upon activation of switch 33 the solenoid 34 raises rollers 31 to release the driving force causing the paper to move along path 24. Simultaneously, solenoid 35 is energized to lower drive rollers 36 to cause the paper to move at 90° along paper path 25, around the turnaround, and into the duplexing tray 26 where it is stopped. After all copies of side 1 are located in bin 26 and the machine is ready for copying side 2, solenoid 37 is actuated, causing the activation of suitable feeding means to drive the paper out of bin 26 and along paper path 21 (refer to FIGS. 1 and 2) so that copies may be made of side 2 on the blank sides of the sheets. Suitable feeding means may include roller 38 and paper separator means (not shown) to prevent multiple-paper feed. An example of paper feeding and separating apparatus is found in the IBM TECHNICAL DISCLOSURE BULLETIN, Vol. 14, No. 8, January 1972, p. 2396. Note what has happened — the paper has been turned under the fuser and stopped; it has been moved at a 90° angle, turned over and stopped; it has been started at another 90° angle which canceled the first 90° angle and is again turned over by paths 21 and 15 heading into the transfer station. In that manner, the paper is presented blank side up while maintaining the leading edge for the duplexing operation.

If the copies are to be collated after duplexing, the copy sheet is fed once again around paper path 24 into top tray 30 of apparatus 20. Once again, the leading edge of the paper strikes the microswitch 33 which causes the paper to be moved at a 90° along paper path 25. Solenoid 39 is energized to cause the gate 40 to open so that the copy paper passes under the duplex bin 26 onto a bottom tray 41. The presence of the paper is again sensed by a switch which energizes solenoid 42 which activates suitable feeding means including drive rollers 43 to move the sheet of paper out of bin 41 along paper path 22 to one of the selected collators as previously described. The operation of gate 40 may be seen better by reference to FIG. 4A where it is shown that drive roller 36 moves the paper along paper path 25 and around the turnaround provided by gate 40 into paper duplexing bin 26, or if the gate is down, into the bottom tray 41.

An alternative and simpler path for collating the duplexed sheets involves simply feeding the copy sheet around paper path 24 into top receiving tray 30 as before. However, instead of moving the paper out at right angles along path 25, simply reverse rolls 31 and move the duplexed sheet back out along path 24' as shown in FIG. 2 into the collator 100. A path 24'' is also provided for moving the paper into collator 200. Obviously, gates to select the desired path would be needed but are not shown in the figures for simplicity.

An important observation may be made concerning the operation of the device 50. Note that all simplexed copies are collected in duplex tray 26 and are fed from tray 26 to the copier machine for duplexing. If these duplexed sheets are to be collated, they are fed back into apparatus 50 on tray 30 and transferred to the collator either via turnaround gate 40 and tray 41 or back out along path 24' or 24''. Thus, device 50 acts to feed the duplexing and turn for collating simultaneously.

While the invention has been particularly shown and described with reference to a preferred embodiment thereof, it will be understood by those skilled in the art that the foregoing and other changes in form and details may be made therein without departing from the spirit and scope of the invention.

What is claimed is:

1. In a document copier machine wherein an electrostatic image is placed upon a copy sheet at a transfer station and said image is fused to said copy sheet at a fusing station, apparatus for automatically providing duplexed copies comprising:

guide means for receiving a simplexed copy sheet from said fusing station and guiding said copy sheet around a 180° bend into a first direction and onto a receiving tray;

first stop means for stopping said copy sheet in said tray;

turnaround means for moving said copy sheet at 90° to said first direction and guiding said sheet around a 180° bend into a duplex bin;

second stop means for stopping said copy sheet in said duplex bin; and sheet moving means for moving said sheet in said first direction and guiding said sheet around a 180° bend into said transfer station, whereby a duplexed copy is provided while maintaining the leading edge of the copy sheet constant for both passes through said transfer station.

2. The apparatus of claim 1 including a collator wherein said duplexed sheet passes through said fusing station a second time, and into said receiving tray, an alternate paper path comprising:

gate means for altering the paper path provided by said turnaround means so that said sheet is fed by said turnaround means into a collator tray;

third stop means for stopping said sheet in said collator tray; and second sheet moving means for moving said sheet out of said collator tray around a 180° bend into said collator, whereby duplexed sheets are stacked in correct numerical order in said collator.

3. The method of automatically making duplexed copies in a copy machine, comprising the steps of:

receiving a simplexed copy sheet in a first plane from a fusing station and turning said copy sheet over by guiding it around a 180° bend into a second plane while maintaining the leading edge constant;

moving said copy sheet at 90° in said second plane by selecting a new leading edge;

turning said copy sheet over by guiding it around a 180° bend into a third plane;

moving said copy sheet at 90° in said third plane by selecting the original leading edge; and turning said copy sheet over and feeding it into said copy machine for copying on the blank side of said sheet, whereby a duplexed copy is produced while maintaining the original leading edge of the copy sheet for both passes through said copy machine.

4. The method of claim 3 wherein said copy machine includes a collator, further including the steps of:

receiving said duplexed copy sheet from said fusing station and turning said copy sheet over by guiding it around a 180° bend into said second plane; and moving said copy sheet from said second plane into said collator, whereby duplexed sheets are stacked in correct numerical order in said collator.

5. The method of automatically making duplexed copies in a document copier machine, comprising the steps of:

receiving a simplexed copy sheet from a fusing station in said machine and inverting said copy while maintaining the leading edge moving in a first direction;

moving said copy at 90° to said first direction by selecting a new leading edge and inverting said copy;

moving said copy in said first direction and inverting said copy; and feeding said copy into said machine for copying the second side, whereby a duplexed copy is produced while maintaining the original leading edge of the copy sheet for both passes through said copy machine.

6. The method claim 5 wherein said machine includes a collator, further comprising the steps of:

receiving said duplexed copy from said fusing station;

inverting said copy; and moving said copy into said collator, whereby duplexed sheets are stacked in correct numerical order in said collator.

* * * * *